US006367449B1

(12) United States Patent
Moteki et al.

(10) Patent No.: US 6,367,449 B1
(45) Date of Patent: Apr. 9, 2002

(54) SLIDING MODE CONTROL UNIT OF ELECTRONICALLY CONTROLLED THROTTLE DEVICE

(75) Inventors: Norio Moteki; Kenichi Machida, both of Atsugi (JP)

(73) Assignee: Unisia Jecs Corporation, Kanagaga-Ken (JP)

( * ) Notice: Subject to any disclaimer, the term of this patent is extended or adjusted under 35 U.S.C. 154(b) by 0 days.

(21) Appl. No.: 09/714,666

(22) Filed: Nov. 17, 2000

(30) Foreign Application Priority Data

Nov. 19, 1999 (JP) ..... 11-330448

(51) Int. Cl.[7] ..... F02D 9/10
(52) U.S. Cl. ..... 123/399; 123/361
(58) Field of Search ..... 123/361, 399

(56) References Cited

U.S. PATENT DOCUMENTS 4,849,896 A * 7/1989 Burk et al. ..... 123/337
5,233,958 A * 8/1993 Knoss et al. ..... 123/399
5,320,076 A * 6/1994 Reppich et al. ..... 123/399
5,992,383 A * 11/1999 Scholten et al. ..... 123/399

FOREIGN PATENT DOCUMENTS

EP 0 583 476 8/1993
JP 4-224425 8/1992
JP 7-133739 5/1995

OTHER PUBLICATIONS

Vlg.H. Deutsch, "*Taschenbuch der Regelungstechnik,*" 1998, pp. 28–31 (w/English Translation).

* cited by examiner

*Primary Examiner*—Erick Solis
(74) *Attorney, Agent, or Firm*—McDermott, Will & Emery

(57) ABSTRACT

In electronically controlling the opening of a throttle valve mounted in an intake system of an engine, the opening is controlled through a sliding mode control, based on a control amount including a control amount portion proportional to the switching function and a control amount portion corresponding to a nonlinear spring torque of a return spring urging said throttle valve in a direction to reduce the throttle valve opening. According to this constitution, the response characteristic of the control unit is maintained while restraining overshoot, enabling the opening to converge to the target opening promptly while sliding along a switching plane. Further, since said control amount includes the control amount portion corresponding to the nonlinear spring torque of the return spring, uncertainty element is reduced, to thereby perform a high response control.

16 Claims, 4 Drawing Sheets

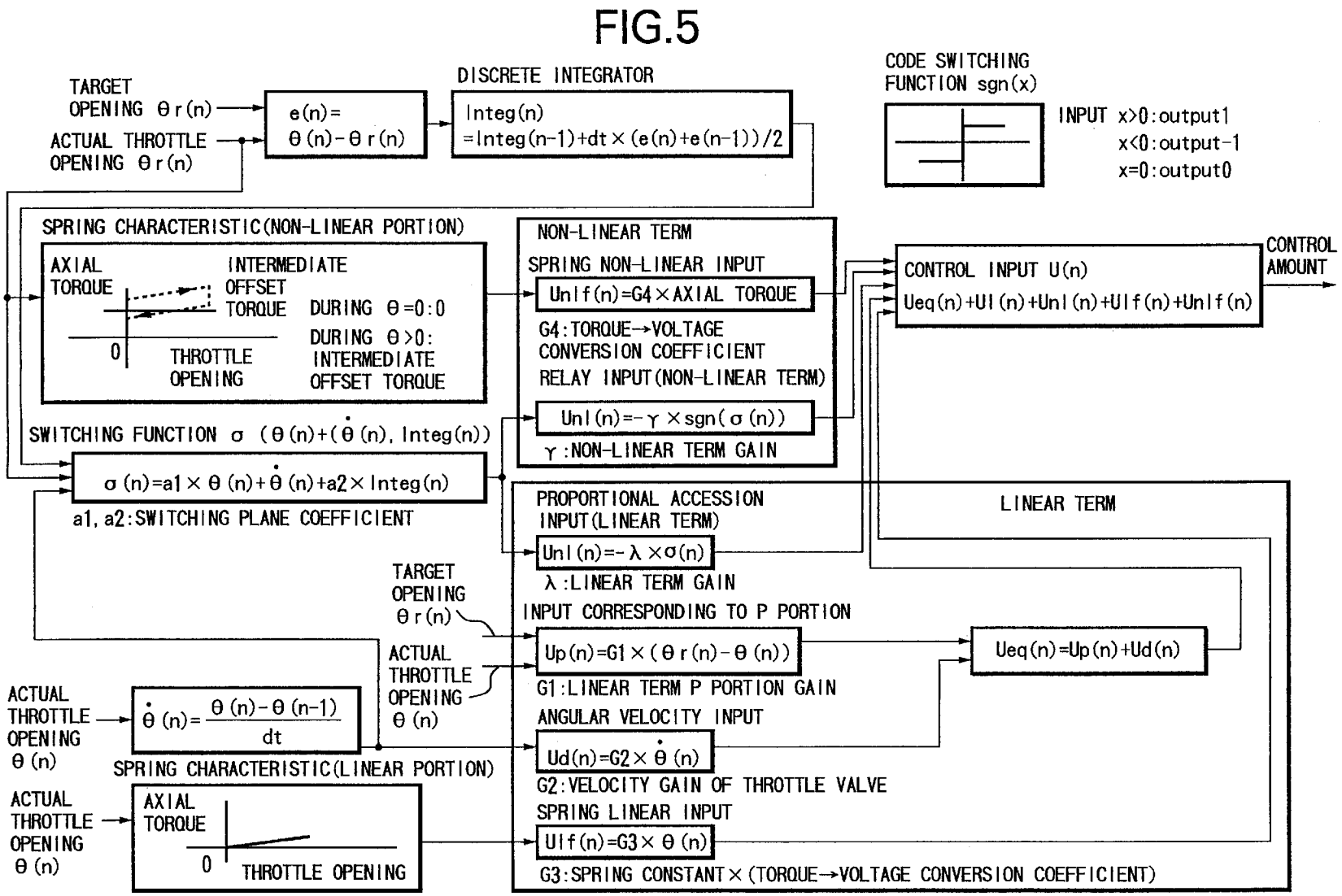
FIG.5
TARGET OPENING θr(n)
ACTUAL THROTTLE OPENING θr(n)
e(n)= θ(n)-θr(n)
DISCRETE INTEGRATOR
Integ(n) =Integ(n-1)+dt×(e(n)+e(n-1))/2
CODE SWITCHING FUNCTION sgn(x)
INPUT x>0:output1
x<0:output-1
x=0:output0
SPRING CHARACTERISTIC(NON-LINEAR PORTION)
AXIAL TORQUE
INTERMEDIATE OFFSET TORQUE
DURING θ=0:0
DURING θ>0: INTERMEDIATE OFFSET TORQUE
THROTTLE OPENING
SWITCHING FUNCTION σ (θ(n)+(θ̇(n), Integ(n))
σ(n)=a1×θ(n)+θ̇(n)+a2×Integ(n)
a1, a2:SWITCHING PLANE COEFFICIENT
NON-LINEAR TERM
SPRING NON-LINEAR INPUT
Unlf(n)=G4×AXIAL TORQUE
G4:TORQUE→VOLTAGE CONVERSION COEFFICIENT
RELAY INPUT(NON-LINEAR TERM)
Unl(n)=-γ×sgn(σ(n))
γ:NON-LINEAR TERM GAIN
CONTROL AMOUNT
CONTROL INPUT U(n)
Ueq(n)+Ul(n)+Unl(n)+Ulf(n)+Unlf(n)
LINEAR TERM
PROPORTIONAL ACCESSION INPUT(LINEAR TERM)
Unl(n)=-λ×σ(n)
λ:LINEAR TERM GAIN
INPUT CORRESPONDING TO P PORTION
Up(n)=G1×(θr(n)-θ(n))
G1:LINEAR TERM P PORTION GAIN
ANGULAR VELOCITY INPUT
Ud(n)=G2×θ̇(n)
G2:VELOCITY GAIN OF THROTTLE VALVE
SPRING LINEAR INPUT
Ulf(n)=G3×θ(n)
G3:SPRING CONSTANT×(TORQUE→VOLTAGE CONVERSION COEFFICIENT)
Ueq(n)=Up(n)+Ud(n)
TARGET OPENING θr(n)
ACTUAL THROTTLE OPENING θ(n)
θ̇(n)= (θ(n)-θ(n-1))/dt
SPRING CHARACTERISTIC(LINEAR PORTION)
AXIAL TORQUE
0
THROTTLE OPENING
ACTUAL THROTTLE OPENING θ(n)
ACTUAL THROTTLE OPENING θ(n)

SLIDING MODE CONTROL UNIT OF ELECTRONICALLY CONTROLLED THROTTLE DEVICE

FIELD OF THE INVENTION

The preset invention relates to a sliding mode control unit for controlling a throttle device of an engine that is controlled electronically (hereinafter called an electronically controlled throttle device).

DESCRIPTION OF THE RELATED ART

Heretofore, it is common for an electronically controlled throttle device to apply a PI control using a P portion and an I portion, or a PID control further using a D portion, based on a deviation (error amount) between the target opening and the actual opening of a throttle valve. However, according to the PI control or the PID control, robust characteristic is low (easily influenced by disturbance), and the accuracy of the throttle control having a nonlinear property is insufficient.

On the other hand, a sliding mode control is known as a control method having high robust characteristics with restraining influence from disturbance. Application of the sliding mode control to the throttle control realizes a highly accurate control of the throttle valve opening with high robust characteristics (refer to Japanese Unexamined Patent Publication No. 7-133739).

However, according to the conventional sliding mode control, the object of control did not converge promptly to the switching plane when the target value was changed greatly. That is, when the state of the control object is separated greatly from the switching plane, if the speed for approaching the state of the control object to the switching plane is simply increased, the control object tended to pass through the switching plane to increase overshoot. In such a case, the control object could not converge promptly to the switching function.

SUMMARY OF THE INVENTION

The present invention aims at solving the above mentioned problems. With an electronically controlled throttle device, an object of the invention is to enable a good sliding mode control to be performed so that the opening of the throttle valve converges promptly to a switching plane even when a target value is changed greatly.

Another object of the invention is to improve a response characteristic in the sliding mode control, considering an influence by a return spring urging the throttle valve in a direction to return the throttle valve to an initial position.

Yet another object of the invention is to converge the throttle valve opening effectively, without having steady deviation against the target value.

In order to achieve the above objects, the present invention is constituted:

when performing a sliding mode control of the opening of a throttle valve mounted in an intake system of an engine, to compute a control amount portion proportional to a switching function utilized in the sliding mode control;

to compute a control amount portion corresponding to a nonlinear spring torque of a return spring urging the throttle valve in a direction to reduce the throttle valve opening;

to compute a control amount of the opening of the throttle valve including the control amount portion proportional to the switching function and the control amount portion corresponding to the nonlinear spring torque; and to perform the sliding mode control of the throttle valve opening based on the computed control amount.

According to this constitution, the control amount portion proportional to the switching function $\sigma$ is included in the control amount. Therefore, when a target value of the throttle valve opening is changed greatly and separates widely from the switching plane that is defined as $\sigma=0$, since the control amount has a large control amount portion proportional to the switching function $\sigma$, the throttle valve opening starts to approach the switching plane with a great speed. As the throttle valve opening approaches the switching plane, the control amount portion proportional to the switching function $\sigma$ reduces, and the speed in approaching the switching plane is also reduced, thereby the throttle valve opening reaches the switching plane while restraining overshoot. After reaching the switching plane, the throttle valve opening slides along the switching plane while the direction of control is changed carefully, to converge to the target value.

Accordingly, a high accurate sliding mode control of the throttle valve opening can be performed while ensuring a high response characteristic with little influence from disturbance.

Moreover, since the control amount includes the control amount portion corresponding to the nonlinear spring torque of the return spring, uncertainty element is reduced, enabling a higher response control.

In addition to the above-mentioned constitution, the switching function may be computed so as to include, as components, the actual opening of the throttle valve, a differential value of the actual opening, and an integral value of a deviation between the actual opening and a target opening.

According to the above constitution, provided that the switching function $S=\alpha1\cdot\theta+\alpha2\cdot\theta'+\alpha3\cdot\int(\theta-r)dr$ (wherein $\theta$: actual opening, r: target opening), during convergence in an initial system state, becomes $\theta=0$, the differential value of $\theta$ is $\theta'=0$, and the integral value of the deviation between $\theta$ and r is $\int(\theta-r)dr=0$, and as a result, the switching function S equals 0. Moreover, even during convergence in the state other than the initial state ($\theta'=0$), $\alpha1$ and $\alpha3$ can be set so that switching function $S=\alpha1\cdot+\theta+\alpha3\cdot\int(\theta-r)dr=0$.

Accordingly, the switching function S can be always 0 during convergence in all states of the system. As a result, it is possible to realize a control system having no steady deviation. Moreover, there is no need to switch a gain of linear term control amount in order to constrain the valve opening to the switching plane (S=0), which leads to reduced ROM constant, and saving of ROM capacity.

Further, the control amount corresponding to the nonlinear spring torque may be computed to be a value variable according to the throttle valve opening.

The return spring is provided with a set load at the throttle valve opening=0 as a drag to a stopper. Therefore, for example the control amount portion corresponding to the nonlinear spring torque of the return spring is not provided when the throttle valve opening =0, resulting in the control amount portion=0. When the throttle valve opening is larger than 0, the control amount portion obtained by adding the set load to an urging force against the elasticity of the return spring corresponding to the throttle valve opening is provided.

According to this constitution, the control amount may be computed with a high accuracy so as to cope with the nonlinear spring torque to be changed according to the throttle valve opening.

Further, the computed value of the control amount of the throttle valve opening may include at least one of a control amount portion proportional to a deviation between an actual opening and a target opening of the throttle valve, a control amount portion proportional to a differential value of the actual opening of the throttle valve and a control amount portion proportional to the elasticity of the return spring of the throttle valve, in addition to the control amount portion proportional to the switching function and the control amount portion corresponding to the non-linear spring torque.

According to this constitution, the control with a higher response characteristic can be performed by using the computed value.

Moreover, the control amount corresponding to the nonlinear spring torque may be computed to be values different from each other during increase of the throttle valve opening and during decrease of the throttle valve opening.

The nonlinear spring torque of the return spring has hysteresis caused by friction and the like according to the open/close directions of the throttle valve opening. Therefore, the control amount corresponding to the nonlinear spring torque is computed to be values different from each other according to the hysteresis during increase of the throttle valve opening and during decrease of the throttle valve opening.

In this way, a higher response control can be performed using the computed value.

Furthermore, the control amount corresponding to the nonlinear spring torque may be computed to be an intermediate value obtained by averaging the values different from each other during increase of the throttle valve opening and during decrease of the throttle valve opening.

According to this constitution, a simple control can be performing while ensuring a good response characteristic by using a single intermediate value obtained by averaging the different values according to the hysteresis of the nonlinear spring torque.

The other objects and features of this invention will become understood from the following description with reference to the accompanying drawings.

BRIEF EXPLANATION OF THE DRAWINGS

FIG. 5 is a control block diagram of the above embodiment.

DETAILED DESCRIPTION OF THE PREFERRED EMBODIMENT

An embodiment of the present invention will now be explained with reference to the drawings.

Figure 1:
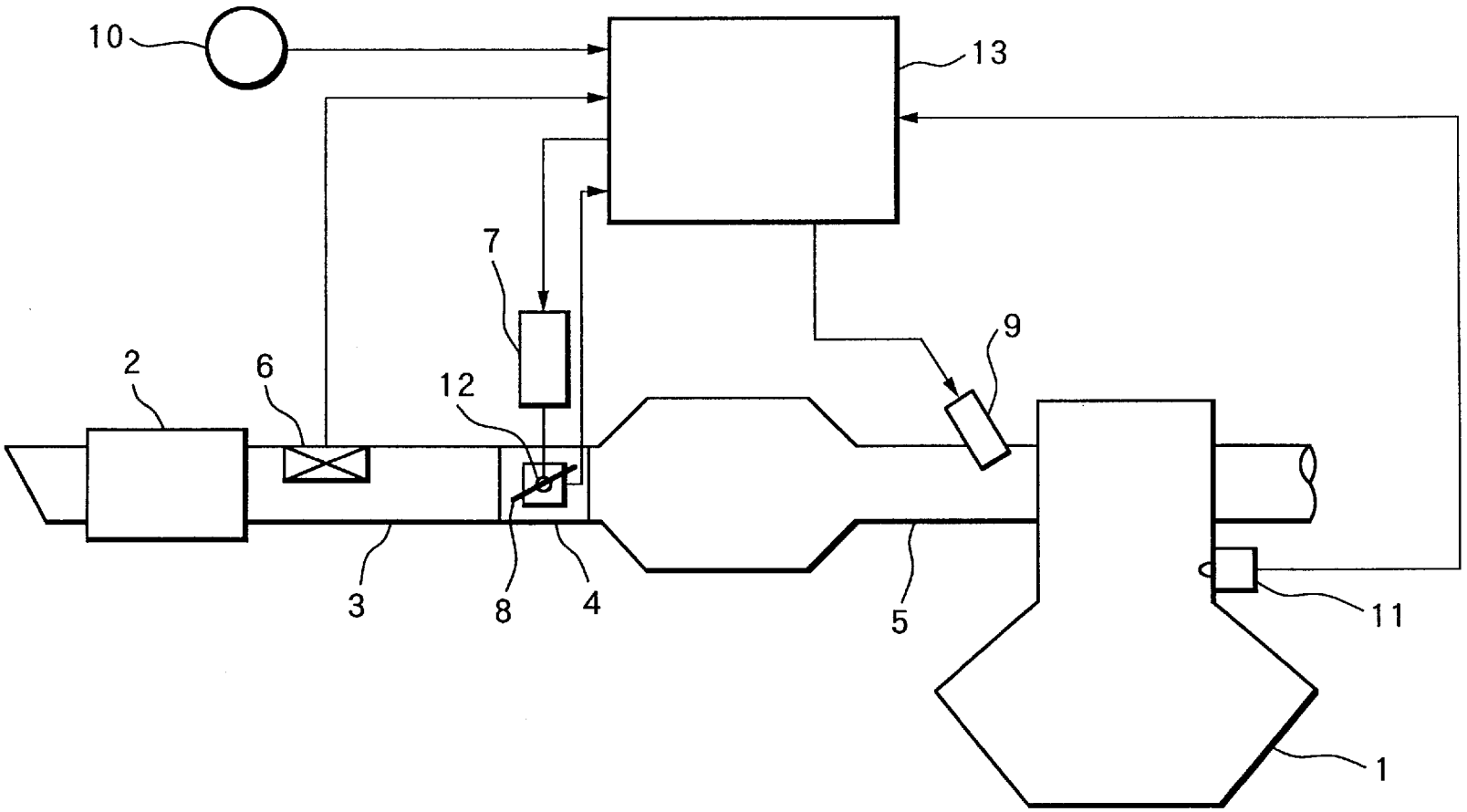
FIG. 1 is a diagram showing the overall system of an embodiment according to the present invention.

FIG. 1 shows an engine equipped with an electronically controlled throttle device applied with the sliding mode control according to the present invention, and a control system thereof. Air is sucked into an engine 1 through an air cleaner 2, an intake duct 3, a throttle chamber 4 and an intake manifold 5.

An airflow meter 6 for detecting an intake airflow quantity Q is mounted to the intake duct 3.

A throttle valve 8 driven by an actuator (motor) 7 is mounted to the throttle chamber 4, for controlling the intake airflow quantity Q.

An electromagnetic fuel injection valve 9 is provided on the intake manifold 5 for each cylinder, for injectingly supply fuel to the cylinder.

Moreover, detection signals from various sensors are input to a control unit 13 equipped with a microcomputer. The various sensors include a crank angle sensor 10 that outputs a reference signal for every predetermined crank angle position corresponding to a specific stroke of each cylinder and further outputs a unit crank angle signal at every unit crank angle (for example, 1 degree or 2 degrees), a water temperature sensor 11 for detecting the engine cooling water temperature, and a throttle sensor 12 for detecting the opening of the throttle valve 8.

The control unit 13 detects the engine rotation speed Ne by measuring the cycle of the reference signal output from the crank angle sensor 10 or the number of input of the unit crank angle signal within a fixed time, and performs the fuel injection control and the ignition control according to the operating condition of the engine obtained based on other detection signals, and further performs the opening control (throttle control) of the throttle valve 8 utilizing a sliding mode control according to the present invention through the actuator 7.

The throttle control based on the sliding mode control will now be explained.

Figure 2:
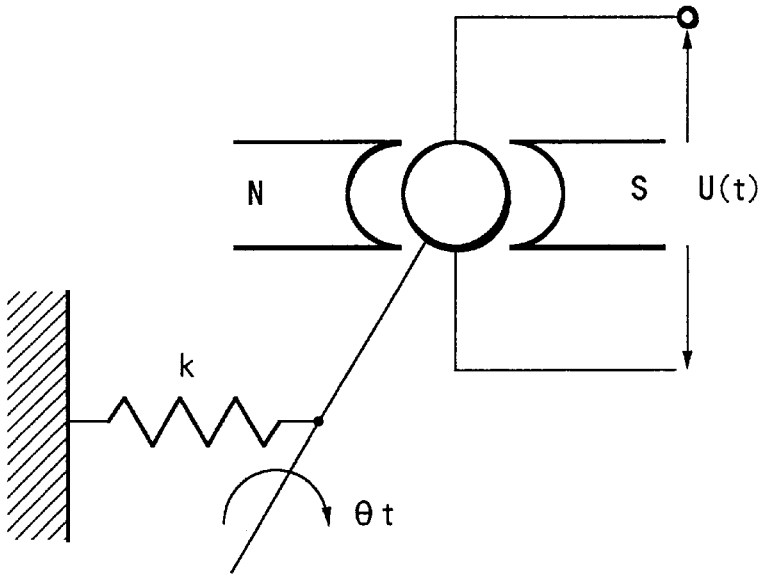
FIG. 2 is a diagram showing a model of the electronically controlled throttle device according to the above embodiment.

The equation of state is obtained based on the mathematical model of the electrical system and the mechanical system of the electronically controlled throttle device (refer to FIG. 2).

The mathematical model of the electrical system is represented as the following formula.

$$L\cdot(dI/dt)+RI+Kv\cdot(d\theta/dt)=U \quad (1)$$

The mathematical model of the mechanical system is represented as the following formula.

$$J\cdot(d^2\theta/dt^2)+D\cdot(d\theta/dt)+F(\theta)+d=Kf\cdot I \quad (2)$$

Each parameter in formula (1) and (2) are as follows.

$\theta$[rad]: actual opening of the throttle valve (=motor)

I[A]: current provided to R/SOL (motor)

U[V]: R/SOL (motor) voltage (set as control input)

J[kgm$^2$]: moment of inertia

D[NMs/rad]: viscous drag coefficient

F($\theta$)[Nm]: spring torque of return spring

Kf[Nm/A]: torque coefficient

L[H]: coil inductance

R[$\Omega$]: resistance

Kv[Vs/rad]: counter electromotive voltage constant d: disturbance torque caused by modeling error and the like Firstly, formula (1) is deformed as $I=(V-Kv\cdot\theta'-L\cdot I)/R$, and then assigned to formula (2) as follows:

$$J\cdot R\cdot\theta''+(D\cdot R+Kv\cdot Kf)\theta'+R\cdot F(\theta)=Kf\{U-(R/Kf)\cdot d-L\cdot I'\}=Kf(U-dI)$$
$$\text{where } dI=(R/Kf)\cdot d+L\cdot I' \quad (3)$$

Figure 3:
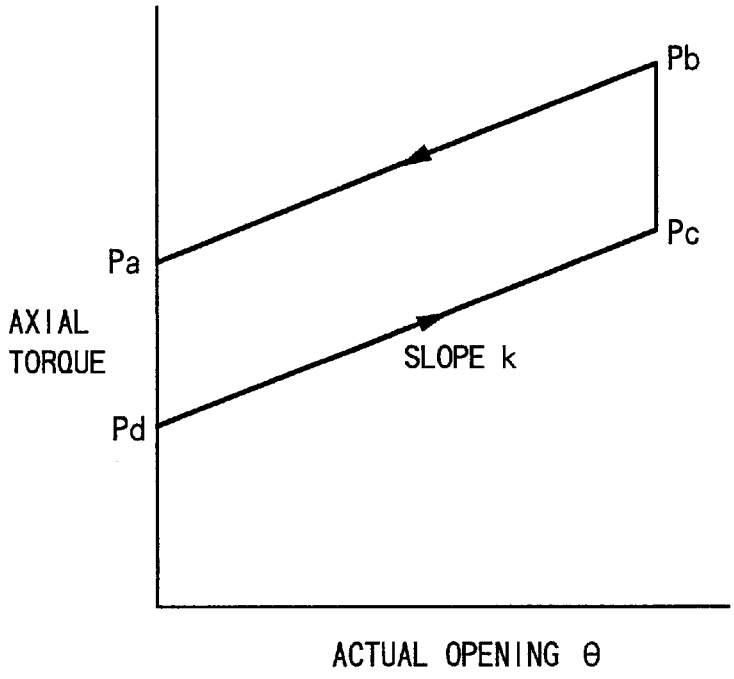
FIG. 3 is a graph showing the axial torque property of the above-mentioned electronically controlled throttle device.

Here, according to the axial torque—angle characteristics of the ETC (electronically controlled throttle device) (refer to FIG. 3), the spring torque F (θ) of the return spring is represented as the following formula.

$$F(\theta)=k\cdot\theta+Fd(\theta),\text{ wherein if }\theta>0,\text{ then }Fd(\theta)=Pa\text{ (opening increasing) or Pd (opening decreasing), and if }\theta=0,\text{ then }Fd(\theta)=0 \quad (4)$$

k: spring constant [Nm/rad]

Pa: nonlinear spring torque during increase of opening

Pd: nonlinear spring torque during decrease of opening

Formula (4) is assigned to formula (3) as follows:

$$J\cdot R\cdot\theta''+(D\cdot R+Kv\cdot Kf)\theta'+R\{k\cdot\theta+Fd(\theta)\}=Kf(U-dI)\theta''=-(D/J+Kv\cdot Kf/JR)\theta'-(k\cdot\theta+Fd(\theta)/J+Kf(U-dI)/JR \quad (5)$$

When r is set as target opening, and the state variable is set as $X=[\theta\theta'\int(\theta-\theta r)dt]^T$, the equation of state is represented by the following formula.

$$X'=A\cdot X+B\cdot U+g\cdot\theta r+hl\cdot dI+h2\cdot Fd(\theta) \quad (6)$$

$$A=\begin{bmatrix} 0 & 1 & 0 \\ -k/J & -(D/J+Kv\cdot Kf/J\cdot R) & 0 \\ 1 & 0 & 0 \end{bmatrix}$$

$B=[0\ Kf/JR\ 0]^T$ $g=[0\ 0-1]^T$ $h1=[0-Kf/JR\ 0]^T$ $h2=[0-1/J\ 0]^T$

Next, the switching function a is designed as the following formula using the state variable X.

$$\sigma=\alpha X=[\alpha 1\ 1\alpha 3]X \quad (7)$$

Next, the equivalent control input during the time the state has reached a switching plane and sliding mode has occurred is computed.

When sliding mode has occurred, the next formula exists.

$$\sigma=\sigma'=0 \quad (8)$$

The control input at this time is equivalent to the equivalent control input Ueq, and based on formulas (6) and (8), it is represented by the following formula.

$$\sigma'=\alpha X'=\alpha\{A\cdot X+B\cdot Ueq+g\cdot\theta r+h1\cdot h2+h2\cdot Fd(\theta)\}=0\rightarrow Ueq=-(\alpha\cdot B)^{-1}\{\alpha A\cdot X+\alpha\cdot g\cdot\theta r+\alpha\cdot h1\cdot d+\alpha\cdot h2\cdot Fd(\theta)\} \quad (9)$$

When assigning formula (9) to formula (6), $$X'=\{I\text{ (unit matrix)}-B(\alpha\cdot B)^{-1}\alpha\}A\cdot X^{-1}-B(\alpha\cdot B)\cdot(\alpha\cdot g\cdot\theta r+\alpha\cdot h1\cdot g+\alpha\cdot h2\cdot Fd(\theta)+g\cdot\theta r+h1\cdot d1+h2\cdot Fd(\theta)) \quad (10)$$

$$=\begin{bmatrix} 0 & 1 & 0 \\ -\alpha 3 & -\alpha 1 & 0 \\ 1 & 0 & 0 \end{bmatrix}X-\begin{bmatrix} 0 \\ -\alpha 3 \\ 1 \end{bmatrix}\theta r.$$

When the term of θ" is taken out of formula (10), the formula becomes $$\theta''=-\alpha 3\cdot\theta-\alpha 1\cdot\theta'+\alpha\cdot 3r \quad (11)$$

and when Laplace transform is performed to formula (11), the formula represents the transmission function G (S) of the whole system.

$$S^2\cdot\theta(S)=-\alpha 3\cdot\theta(S)+\alpha 1\cdot S\cdot\theta(S)+\alpha 3\cdot R(S)\rightarrow G(S)=\theta(S)/R(S)=\alpha 3/(S^2+\alpha 1\cdot S+\alpha 3) \quad (12)$$

On the other hand, when the whole system is set as a secondary vibration system, with the natural frequency [rad/Sec] set as ω and damping function set as ζ, the transfer function becomes;

$$G(S)=\theta(S)/R(S)=K(S^2+2\zeta\cdot\omega\cdot S+\omega^2)K\text{: constant gain.} \quad (13)$$

From formulas (12) and (13), $$\alpha 1=2\zeta\omega,\ \alpha 3=\omega^2. \quad (14)$$

Therefore, the switching function σ can be computed based on (7) and (14) by the following formula.

$$\sigma=[2\zeta\cdot\omega 1\omega^2]\cdot[\theta\theta'\int(\theta-\theta r)dt]^T=2\zeta\cdot\omega\cdot\theta+\theta'+\omega^2\cdot\int(\theta-\theta r)dt \quad (15)$$

Utilizing the switching function σ set as above, the control amount U of the present unit is computed as follows.

$$U=Ueq+Unl+Ul+Uf \quad (16)$$

Here, Ueq is an equivalent control input excluding the control input corresponding to the disturbance torque d and the control input corresponding to the nonlinear spring torque Fd (θ) of formula (9), and is shown as the following formula.

$$Ueq=-(\alpha\cdot B)^{-1}(\alpha\cdot A\cdot X+\alpha\cdot g\cdot\theta r) \quad (17)$$

Further, Unl and Ul are control inputs for reaching the switching plane and for removing the influence from disturbance, and in formula (9), are set as a control input corresponding to the disturbance torque d. Of these two, Unl is set using the switching function σ as the following formula, similar to the nonlinear term in a conventional sliding mode control.

$$Unl=\gamma\cdot(\alpha\cdot\beta)^{-1}\cdot(\sigma/|\sigma|) \quad (18)$$

In other words, Unl is set as a feedback control amount, the positive and negative of which is switched every time the switching plane (the state of which is defined as σ=0) is crossed. It comprises a basic function of the sliding mode control, wherein after the state reaches the switching plane, it slides along the switching plane to approach the target value.

On the other hand, Ul is set as a control input according to the present invention, set as a value multiplying the gain to the switching function σ, as shown in the following formula.

$$Ul=\lambda\cdot(\alpha\cdot B)^{-1}\sigma \quad (19)$$

Uf is a control input corresponding to the offset torque according to the nonlinear spring characteristic of the return spring urging the throttle valve in the direction to reduce the throttle valve opening, which is computed by the following formula.

$$Uf=-(\alpha\cdot B)^{-1}\cdot\alpha\cdot h2\cdot Fd(\theta)=(R/Kf)\cdot(Pa+Pd)/2(\text{when }\theta>0)=0\text{ (when }\theta=0) \quad (20)$$

Figure 4:
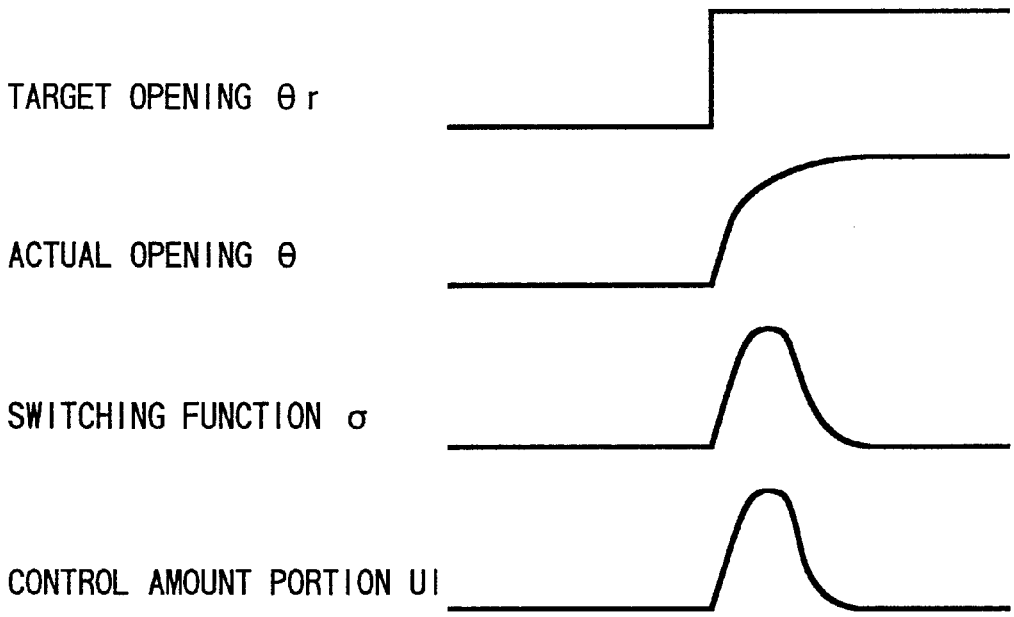
FIG. 4 a diagram showing the state of variation during the control of the above-mentioned embodiment.

As mentioned above, the control amount portion Ul proportional to the switching function σ is included as the linear term in the control amount U. Therefore, as shown in FIG. 4, when the target opening of the throttle valve is changed greatly and separates widely from the switching plane (σ=0), since the control amount U has a large control amount portion Ul proportional to the switching function σ, the throttle valve opening approaches the switching plane with a greater speed. As the throttle valve opening approaches the switching plane, the control amount portion Ul proportional to the switching function σ reduces, and the speed in approaching the switching plane is also reduced, thereby the throttle valve opening reaches the switching plane while restraining overshoot. After reaching the switching plane, the throttle valve opening slides along the switching plane while the direction of control is carefully changed, to converge to the target value.

Accordingly, a high accurate control of the throttle valve opening can be performed while ensuring a high response characteristic with little influence from disturbance.

Moreover, by computing distinctively the control amount portion Uf corresponding to the nonlinear spring torque of the return spring, uncertainty element is reduced, enabling a higher response control.

FIG. 5 is a control block diagram of the above-mentioned embodiment. As shown, the switching function σ (n) is, as disclosed in formula (15), composed of the throttle valve actual opening θ (n), the differential value of the actual opening θ (n), and the integral value of the deviation (error amount) between the actual opening θ (n) and the target opening θr (n).

The linear term is computed by adding a proportional accession portion Ul (n) proportional to the switching function σ. (n) to the proportional portion Up (n) proportional to the error amount, the angular velocity portion Ud (n) proportional to the differential value, and the linear spring torque portion Ulf (n) proportional to the elasticity of the return spring.

On the other hand, the nonlinear term is computed by adding the nonlinear spring torque portion Unlf (n) of the return spring to the relay portion Unl (n), the positive and negative of which is switched according to the direction to cross the switching surface.

The linear term and the nonlinear term are added to compute the control amount U (n).

In the above mentioned embodiment, in order to simplify the control, an intermediate offset torque portion Uf obtained by averaging the values during increase of the throttle valve opening and during decrease of the throttle valve opening is computed for the nonlinear spring torque of the return spring having hysteresis caused by friction and the like. However, an even more accurate control can be performed using separately computed values for throttle valve opening increase [Uf=(R/Kf)·Pa] and throttle valve opening decrease [Uf=(R/Kf)·Pd].

The entire content of Japanese Patent Application No. 11-330448 filed on Nov. 19, 1999 is incorporated herein by reference.

We claim:

1. A sliding mode control unit of an electronically controlled throttle device, for electronically controlling the opening of a throttle valve mounted in an intake system of an engine through a sliding mode control, comprising a switching function proportional portion computing means for computing a control amount portion proportional to a switching function utilized in said sliding mode control;

a nonlinear spring torque portion computing means for computing a control amount portion corresponding to a nonlinear spring torque of a return spring urging said throttle valve in a direction to reduce the opening of said throttle valve;

a control amount computing means for computing a control amount of the opening of said throttle valve including the control amount portion proportional to said switching function and the control amount portion corresponding to said nonlinear spring torque; and a sliding mode control means for performing the sliding mode control of said throttle valve opening based on said computed control amount.

2. The sliding mode control unit of an electronically controlled throttle device according to claim 1, further comprising a switching function computing means for computing the switching function of said sliding mode control including as components the actual opening of said throttle valve, a differential value of said actual opening, and an integral value of a deviation between said actual opening and a target opening.

3. The sliding mode control unit of an electronically controlled throttle device according to claim 1, wherein said control amount computing means computes a control amount of the opening of said throttle valve including the control amount portion proportional to said switching function, the control amount portion corresponding to said nonlinear spring torque and a control amount portion proportional to a deviation between an actual opening and a target opening of the throttle valve.

4. The sliding mode control unit of an electronically controlled throttle device according to claim 1, wherein said control amount computing means computes a control amount of the opening of said throttle valve including the control amount portion proportional to said switching function, the control amount portion corresponding to said nonlinear spring torque and a control amount portion proportional to a differential value of an actual opening of the throttle valve.

5. The sliding mode control unit of an electronically controlled throttle device according to claim 1, wherein said control amount computing means computes a control amount of the opening of said throttle valve including the control amount portion proportional to said switching function, the control amount portion corresponding to said nonlinear spring torque and a control amount portion proportional to the elasticity of said return spring of the throttle valve.

6. The sliding mode control unit of an electronically controlled throttle device according to claim 1, wherein the control amount corresponding to said nonlinear spring torque is computed to be a value variable according to the throttle valve opening.

7. The sliding mode control unit of an electronically controlled throttle device according to claim 1, wherein the control amount corresponding to said nonlinear spring torque is computed to be values different from each other during increase of the throttle valve opening and during decrease of the throttle valve opening.

8. The sliding mode control unit of an electronically controlled throttle device according to claim 1, wherein the control amount corresponding to said nonlinear spring torque is computed to be an intermediate value obtained by averaging values different from each other during increase of the throttle valve opening and during decrease of the throttle valve opening.

9. A sliding mode control method of an electronically controlled throttle device, for electronically controlling the opening of a throttle valve mounted in an intake system of an engine through a sliding mode control, comprising the steps of:

computing a control amount portion proportional to a switching function utilized in said sliding mode control;

computing a control amount portion corresponding to a nonlinear spring torque of a return spring urging said throttle valve in a direction to maintain an initial opening;

computing a control amount of the opening of said throttle valve including the control amount portion proportional to said switching function and the control amount portion corresponding to said nonlinear spring torque; and performing the sliding mode control of said throttle valve opening based on said computed control amount.

10. The sliding mode control method of an electronically controlled throttle device according to claim 9, further comprising the step of:

computing the switching function of said sliding mode control including as components the actual opening of said throttle valve, a differential value of said actual opening, and an integral value of a deviation between said actual opening and a target opening.

11. The sliding mode control method of an electronically controlled throttle device according to claim 9, wherein the computation of a control amount of said throttle valve is performed by computing a control amount including the control amount portion proportional to said switching function, the control amount portion corresponding to said nonlinear spring torque and a control amount portion proportional to a deviation between an actual opening and a target opening of the throttle valve.

12. The sliding mode control method of an electronically controlled throttle device according to claim 9, wherein the computation of a control amount of said throttle valve is performed by computing a control amount including the control amount portion proportional to said switching function, the control amount portion corresponding to said nonlinear spring torque and a control amount portion proportional to a differential value of an actual opening of the throttle valve.

13. The sliding mode control method of an electronically controlled throttle device according to claim 9, wherein the computation of a control amount of said throttle valve is performed by computing a control amount including the control amount portion proportional to said switching function, the control amount portion corresponding to said nonlinear spring torque and a control amount portion proportional to the elasticity of said return spring of the throttle valve.

14. The sliding mode control method of an electronically controlled throttle device according to claim 9, wherein the control amount corresponding to said nonlinear spring torque is computed to be a value variable according to the throttle valve opening.

15. The sliding mode control method of an electronically controlled throttle device according to claim 9, wherein the control amount corresponding to said nonlinear spring torque is computed to be values different from each other during increase of the throttle valve opening and during decrease of the throttle valve opening.

16. The sliding mode control method of an electronically controlled throttle device according to claim 9, wherein the control amount corresponding to said nonlinear spring torque is computed to be an intermediate value obtained by averaging values different from each other during increase of the throttle valve opening and during decrease of the throttle valve opening.

* * * * *